US005419101A

United States Patent [19]

Gorlich et al.

[11] Patent Number: 5,419,101

[45] Date of Patent: May 30, 1995

[54] GAS EXCHANGE MANIFOLD

[75] Inventors: Michael P. Gorlich; Robert F. McPherson, Jr., both of Hilton Head Island, S.C.

[73] Assignee: World Class Packaging Systems, Inc., Hilton Head Island, S.C.

[21] Appl. No.: 310,867

[22] Filed: Sep. 22, 1994

[51] Int. Cl.[6] ..... B65B 31/00

[52] U.S. Cl. ..... 53/510; 53/79; 53/559; 53/511

[58] Field of Search ..... 53/510, 511, 432, 433, 53/79, 559; 432/404

[56] References Cited

U.S. PATENT DOCUMENTS 3,347,011 10/1967 Lovas et al. ..... 53/511
3,492,773 2/1970 Bergstrom ..... 53/433
4,294,056 10/1981 Paulsen et al. ..... 53/511
4,831,811 5/1989 Nixon, Jr. et al. ..... 53/511
4,909,022 3/1990 Kubis et al. ..... 53/510

*Primary Examiner*—John Sipos
*Assistant Examiner*—Gene L. Kim
*Attorney, Agent, or Firm*—Arnold, White & Durkee

[57] ABSTRACT

A gas exchange manifold includes a pair of plates which may be threadedly connected to one another. Gas supplying passages are formed through the plates to supply a desired gas to the package during fabrication. Also, vacuum supplying passages extend through the same plates and communicate with the package as well. A third plate, which may be sandwiched between other two plates, may contain a plurality of apertures which form part of the gas supplying passages. In this way, the third plate, which may be smaller, may be replaced to provide the desired pattern of apertures for a given configuration of packages being formed.

11 Claims, 3 Drawing Sheets

GAS EXCHANGE MANIFOLD

FIELD OF THE INVENTION

This invention relates to a gas exchange manifold for packaging, such as food packaging. The manifold exhausts an existing gas from within a package before it is closed thereafter supplies the desired gas. This type of apparatus is useful in forming modified atmosphere packaging such as that used for packaging meats and other food products.

BACKGROUND OF THE INVENTION

It is often necessary to withdraw one atmosphere from a package during the packaging process and to substitute a different atmosphere. For example, in modified atmosphere packaging, normal ambient oxygen may be withdrawn by a connection to an appropriate vacuum source and a desired atmosphere, for example composed of inert gases, may be substituted.

One application for this technology is in connection with packaging meats to extend their packaged life. A meat butchered in one location can be packaged in a relatively inert atmosphere so that its useful life is significantly extended. At a later time, the meat could be exposed to oxygen and thereby caused to "bloom" or turn red in color.

In many other applications, it is desirable to package a food product or other item in a specialized atmosphere. To accomplish this, manifolds are used which are capable of connecting the interior of the package selectively to a source of the desired gas or vacuum to withdraw existing gas from the package.

Generally, one or more trays are seated on the manifold, situated within an appropriate enclosure. At the appropriate times, gas is supplied or withdrawn from the tray. To obtain rapid gas exchange, a plurality of apertures are used around the trays to communicate the gas or vacuum source.

Because of the inherent complexity involved in separately supplying two different gaseous conditions to the same package while it is in the same position, these manifolds tend to be structurally complex. The resulting elaborate shapes necessary to supply separately both gas and vacuum communication, result in difficulties in cleaning these devices. As a result, sanitary conditions are difficult to maintain. The desired degree of cleanliness may not be maintained, or if maintained, is achieved at considerable cost both in terms of the cost of cleaning the materials and in downtime of the equipment.

Existing manifolds for these applications use a number of pieces. A block of material is "hogged-out" to form a depression in which the other pieces are inserted. Metal tubes are provided to provide communication with the package through the various plates inserted into the "hogged-out" block. Not only is this "hogged-out" block of metal expensive to manufacture, it tends to be limited in its application to a specific package configuration. Thus, a variety of such blocks may be required. Moreover, the use of tubular passages tends to cause difficulties in assembly and are likely sources for trapping bacteria and dirt. These structures also tend to have a lot of dead space which must be filled with the gas being supplied, increasing the time necessary for gas exchange.

Ideally, a manifold would quickly supply the desired gas under conditions of extreme cleanliness. Moreover, the ideal structure would be readily and easily cleaned. Finally, the ideal structure would have a minimum number of parts, and complex machining operations would be avoided.

SUMMARY OF THE INVENTION

These and other objects of the present invention may be achieved by a manifold for supplying gas and drawing a vacuum from a package. A pair of removably connected plates are provided. One of the plates includes a gas port for receiving a flow of gas and a vacuum port for connection to a vacuum source. At least one gas supplying opening and a plurality of vacuum supplying openings are contained in the other of the plates. At least one gas supplying passage is formed in the plates and is adapted to place the gas port in fluid communication with the gas supplying opening. A plurality of vacuum supplying passages are also formed in the plates which are adapted to place the vacuum port in fluid communication with the plurality of vacuum supplying openings. The vacuum supplying passages are maintained in fluid isolation from the gas supplying passage.

DESCRIPTION OF THE PREFERRED EMBODIMENT

Figure 1:
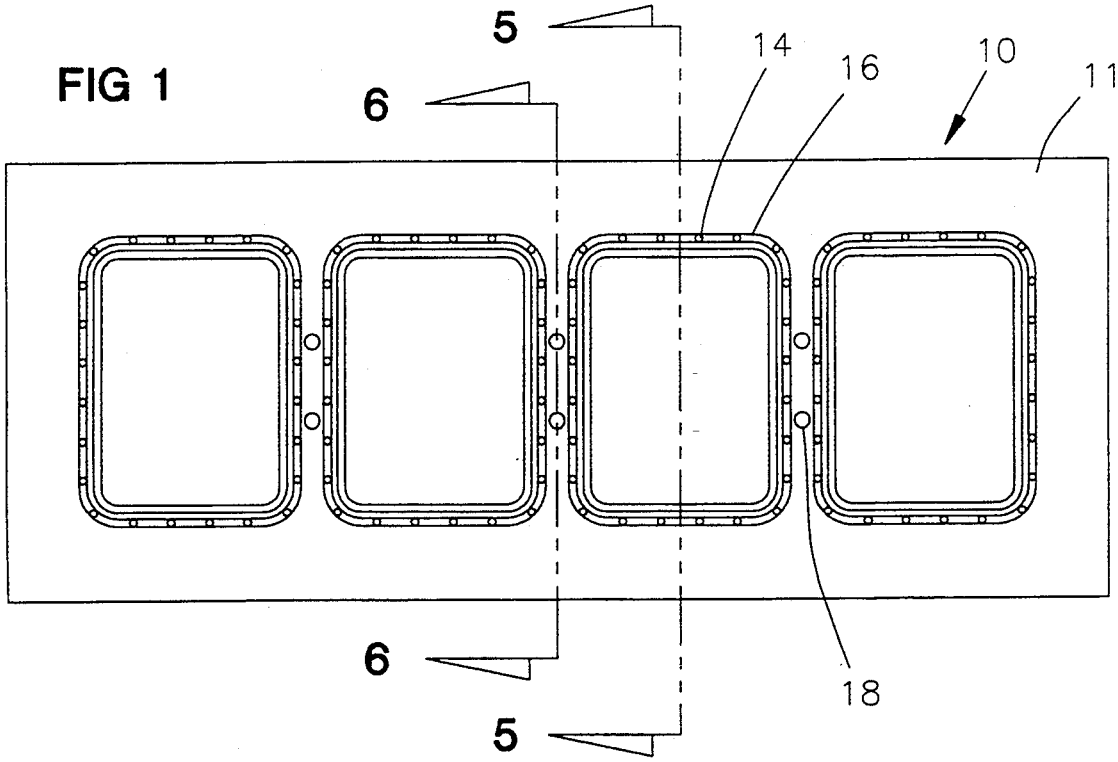
FIG. 1 is a top plan view of one embodiment of the present invention.

Referring to the drawings wherein like references characters are used for like parts throughout the several views, a manifold 10 for supplying gas and drawing a vacuum is arranged in sealed juxtaposition below a machine tray plate 11. The tray plate 11 supports a plurality of trays 12 which comprise a portion of the package to be formed. Commonly, the trays 12 would be loaded with a product to be packaged at this stage in the packaging process.

Figure 5:
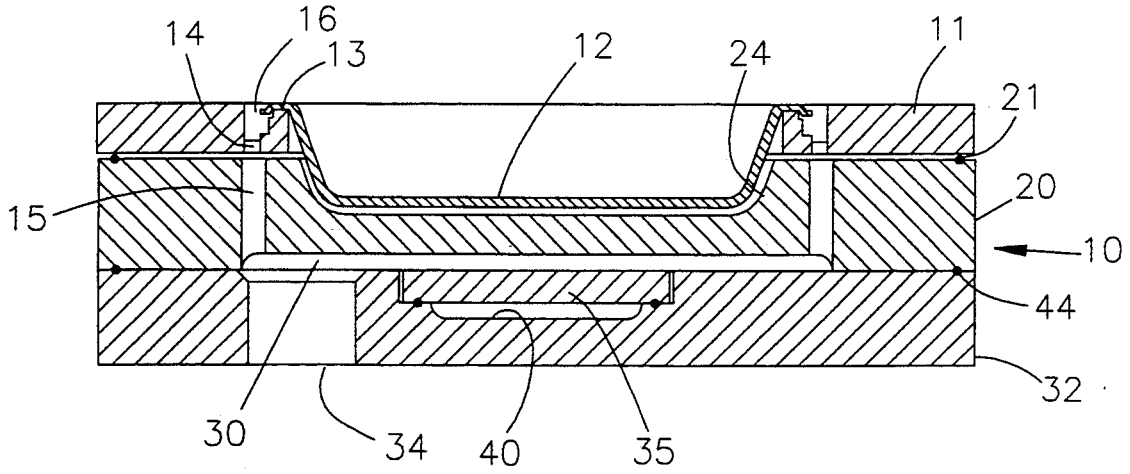
FIG. 5 is a cross-sectional view taken generally along the line of 5—5 in FIG. 1.

As shown in FIG. 5, each of the trays 12 is supported on a lip 13 of the machine tray plate 11. Ideally, the tray plate 11 may be removable from the manifold 10. A tray plate of this type is described in pending U.S. patent application Ser. No. 08/154,756, filed on Nov. 18, 1993, in the names of Gorlich and McPherson, hereby expressly incorporated by reference herein.

A groove 16 completely encircles the lip 13 and provides a distributed opening to permit a vacuum to be drawn from the interior of the package tray 12 through the plate 11. The groove 16 which encircles each tray 12 communicates with a plurality of apertures 14.

As shown in FIG. 1, a plurality of gas apertures 18 extend between various pairs of trays. The exact positioning of these gas apertures 18 is a matter of design or choice and can be varied to fit specific situations.

Figure 2:
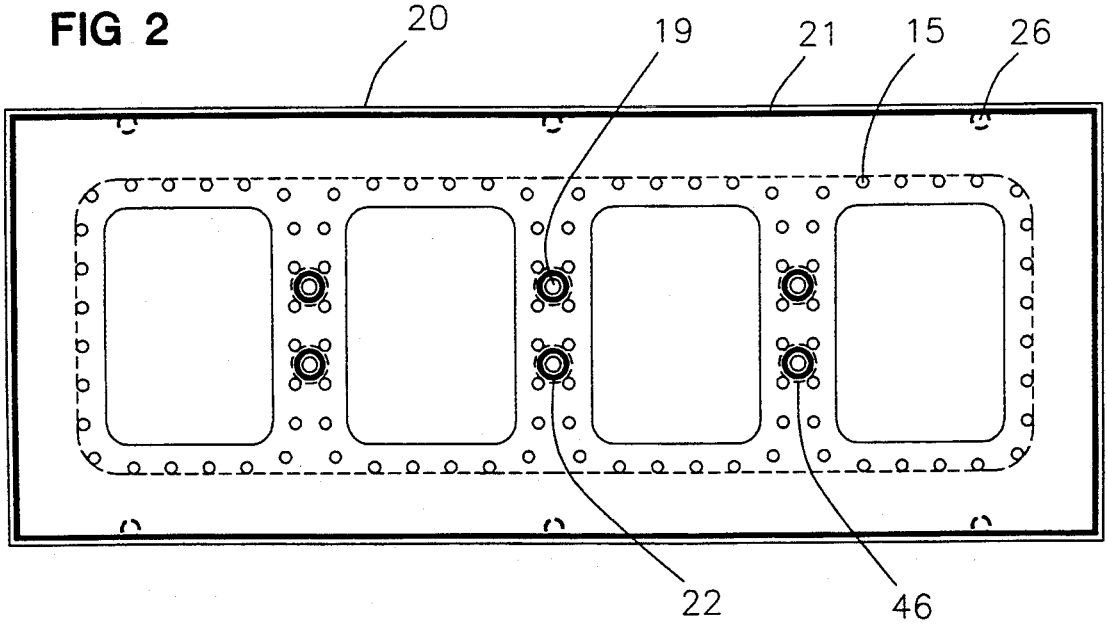
FIG. 2 is a top plan view of the chamber plate which is located beneath the element shown in FIG. 1.
Figure 3:
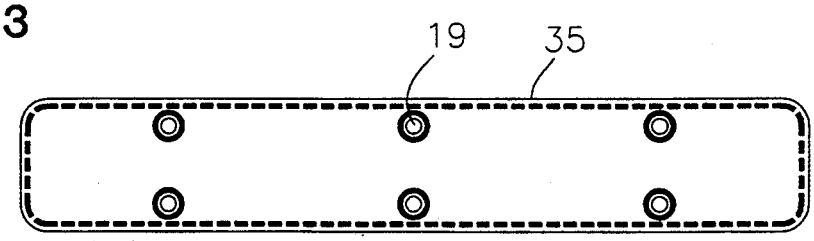
FIG. 3 is a top plan view of a gas distribution plate which is located beneath the chamber plate.
Figure 4:
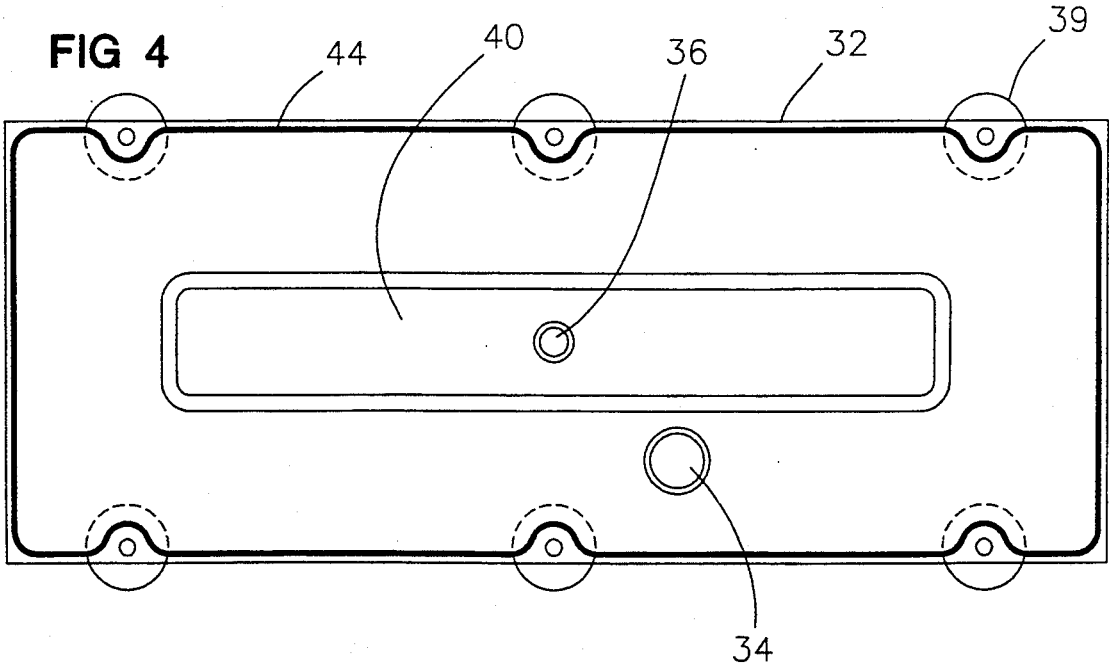
FIG. 4 is a top plan view of a lower chamber plate which is located beneath the chamber plate.
Figure 6:
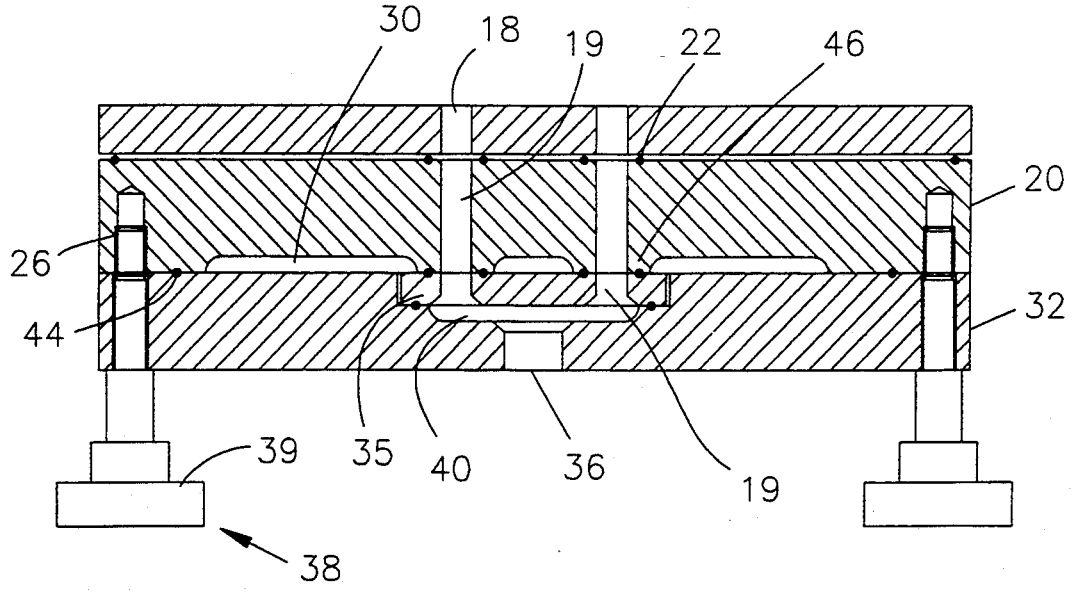
FIG. 6 is a cross-sectional view taken generally along the line of 6—6 in FIG. 1.

The manifold 10 includes a chamber plate 20, shown in FIG. 2, which supports the tray plate 11 as indicated in FIGS. 5 and 6. Ideally a seal 21, which may be an O-ring seal, prevents the infusion of surrounding atmosphere between the plates 11 and 20.

The gas apertures 18 which extend through the plate 11 communicate with the gas passages 19 in the plate 20. The entrance to each passage 19 is encircled by a seal 22, which may be an O-ring seal, to prevent leaking between the plates 11 and 20. Likewise, the apertures 14 in the plate 11 communicate with passages 15 in the plate 20. Each of the passages 15 in turn communicates with a chamber 30 on the lower side of the plate 20. The plate 20 also may include a recess 24 on its upper side to accommodate the tray 12. A plurality of lands 46 extend downwardly through the chamber 30 so as to isolate and define the passages 19 as they extend through the plate 20.

In addition to the plate 20, the manifold 10 includes a lower chamber plate 32. The plate 20 rests atop the lower chamber plate 32. Seals 44 are provided at the points of contact between the plate 20 and the plate 32.

The passages 15 conduct a vacuum from the vacuum supply port 34 to the apertures 14, via the chamber 30. The vacuum supply port 34 may be connected to a conventionally generated source of vacuum.

A gas distribution plate 35 rests in a recess in the lower chamber plate 32. The plate 35 includes a plurality of passages 19 which communicate with the passages 19 in the plates 20. The plate 35 straddles a chamber 40 in the lower chamber plate 32 which provides for fluid communication between the passages 19 and a gas supply port 36. The gas supply port 36 may be connected to a conventional source of the desired gas.

The plates 32 and 20 may be removably connected by a plurality of attachment knobs 38 which are threadedly secured to threaded apertures 26 in the plate 20. The enlarged heads 39 of the knobs 38 permit ready manual disconnection of the plates 20 and 32.

The manifold 10 operates as follows. Initially, a vacuum source is connected to the vacuum port 34 wherein it is communicated via the chamber 30 to the vacuum passages 15 through the plate 20. The chamber 30 acts to distribute the vacuum evenly to the plurality of passages 15. Ultimately, the passages 15 communicate with the tray plate vacuum groove 16 to draw the desired vacuum from within the trays 12. Whatever ambient atmosphere existed within the trays 12, a desired vacuum is supplied quickly and evenly around the trays 12.

After the vacuum source is terminated, a desired gas is then supplied via the gas port 36. The gas port 36 communicates with the passages 19 through the chamber 40 formed in the lower chamber plate 32. Specifically, the gas passages 19 communicate through the gas distributing plate 35 and the chamber plate 20 to the machine tray plate 11 and its apertures 18. A variety of seals between the plates ensure that isolation is maintained between the vacuum passages 14 and the gas passages 18.

The plates 20 and 32 are readily adapted for use with different configurations of trays 12. By simply providing the appropriately sized plate 20 and gas distributing plate 35, the plate 32 can be used with just about any tray configuration. Moreover, because all of the passages are machined in the plates, dead spaces are generally avoided and the gas exchange may be accomplished expeditiously.

The whole apparatus may be easily cleaned. The plates 20 and 32 may simply sandwich the plate 35 between them. When the knobs 28 are quickly disconnected, the whole assembly comes apart for easy cleaning and disinfecting. Because of the use of a minimal number of parts, cleaning is facilitated and greatly simplified. Through the elimination of gas supplying tubes, the sites for the collection of debris and the growth of bacteria are significantly reduced.

Since each of the plates may be defined by relatively simple machining processes, the need for "hogging-out" large metal blocks, as was done in the prior art, is eliminated. Thereby the present invention achieves considerable economies, clear adaptability, and easier cleaning and sanitation.

Thus, it is apparent that there has been provided, in accordance with the invention, a gas exchange manifold that satisfies the aims, objects, and advantages set forth above. While the invention has been described in conjunction with a specific embodiment, it is evident that many alternatives, modifications, and variations would be apparent to those skilled in the art in light of the foregoing description. Accordingly, it is intended to embrace all such embodiments, alternatives, modifications, and variations that fall within the spirit and broad scope of the appended claims.

I claim:

1. A gas exchange manifold for evacuating a package and supplying gas comprising:

a pair of removably connected plates, one of said plates including a recess for said package;

a carrier for said package, said carrier including a recess for said package aligned with said recess in one of said plates;

one of said plates including a gas port for receiving a flow of gas and a vacuum port for providing a vacuum source;

the other of said plates including at least one gas supplying opening and a plurality of vacuum supplying openings;

at least one gas supplying passage formed in said plates and adapted to place said gas port in one plate in fluid communication with said gas supplying opening in said other plate;

a plurality of vacuum supplying passages formed in said plates and adapted to place said vacuum port in one plate in fluid communication with said plurality of vacuum supplying openings in the other plate; and said vacuum supplying passages being maintained in fluid isolation from said gas supplying passage.

2. The manifold of claim 1 wherein said plates are threadedly connected.

3. The manifold of claim 1 including a plurality of gas supplying openings and a plurality of gas supplying passages.

4. The manifold of claim 3 wherein said plates sandwich a third plate between them, said third plate containing apertures which form part of the gas supplying passages.

5. The manifold of claim 4 wherein said third plate is not secured to either of said other plates.

6. The manifold of claim 5 wherein one of said plates includes a recess and said third plate is contained in a recess in one of the other plates.

7. The manifold of claim 3 wherein said vacuum supplying passages include a chamber formed in one of said plates and said gas supplying passages include a chamber formed in the other of said plates, said chambers acting to provide fluid distribution between each of said ports and each said plurality of passages.

8. The manifold of claim 7 wherein said chamber in one of said plates includes protrusions which extend through the vacuum supplying chamber to permit the gas supplying passages to extend in isolation through said vacuum supplying chamber.

9. The manifold of claim 1 wherein said plates are in face to face abutment, a first set of seals between said plates defining gas supplying passages between said plates and a second set of seals isolating said vacuum supplying passages between said plates from the ambient.

10. The manifold of claim 3 wherein said manifold includes gas and vacuum supplying openings for a plurality of packages.

11. The manifold of claim 1 wherein one of said plates is recessed to receive a package for gas exchange.

* * * * *